US007423265B2

(12) United States Patent
Matteo et al.

(10) Patent No.: US 7,423,265 B2
(45) Date of Patent: Sep. 9, 2008

(54) NEAR-FIELD APERTURE HAVING A FRACTAL ITERATE SHAPE

(75) Inventors: Joseph A. Matteo, Lancaster, PA (US); Lambertus Hesselink, Atherton, CA (US); Yin Yuen, San Francisco, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 0 days.

(21) Appl. No.: 11/666,063

(22) PCT Filed: Oct. 21, 2005

(86) PCT No.: PCT/US2005/038042

§ 371 (c)(1), (2), (4) Date: Apr. 18, 2007

(87) PCT Pub. No.: WO2006/047337

PCT Pub. Date: May 4, 2006

(65) Prior Publication Data

US 2008/0088903 A1 Apr. 17, 2008

Related U.S. Application Data

(60) Provisional application No. 60/621,714, filed on Oct. 22, 2004.

(51) Int. Cl.
*G12B 21/06* (2006.01)

(52) U.S. Cl. ..... 250/306; 250/216; 250/227.11; 250/227.2; 250/227.26; 250/234; 359/894; 977/862

(58) Field of Classification Search ..... 250/306, 250/307, 216, 227.11, 227.2, 227.26, 234; 359/894; 977/862

See application file for complete search history.

(56) References Cited

U.S. PATENT DOCUMENTS

| | | | | |
|---|---|---|---|---|
| 5,623,338 | A * | 4/1997 | Wickramasinghe et al. | 356/501 |
| 6,104,349 | A * | 8/2000 | Cohen | 343/702 |
| 6,479,816 | B1 * | 11/2002 | Oumi et al. | 250/306 |
| 6,781,690 | B2 | 8/2004 | Armstrong et al. | |
| 7,095,767 | B1 * | 8/2006 | Thornton et al. | 372/45.01 |
| 2003/0218744 | A1 | 11/2003 | Shalaev et al. | |
| 2005/0031278 | A1 | 2/2005 | Shi et al. | |
| 2005/0084912 | A1 | 4/2005 | Poponin | |

* cited by examiner

*Primary Examiner*—Jack I Berman
(74) *Attorney, Agent, or Firm*—Lumen Patent Firm, Inc.

(57) ABSTRACT

Near-field electromagnetic devices having an opaque metallic screen with a fractal iterate aperture are provided. More specifically, the aperture is obtained by application of a self-similar replacement rule to an initial shape two or more times. Alternatively, the aperture can be obtained by application of a self-similar replacement rule one or more times to an initial C-shape. Such apertures tend to have multiple transmission resonances due to their multiple length scales. Fractal iterate apertures can provide enhanced transmission and improved spatial resolution simultaneously. Enormous improvement in transmission efficiency is possible. In one example, a checkerboard fractal iterate aperture provides $10^{11}$ more intensity gain than a square aperture having the same spatial resolution. Efficient transmission for fractal iterate apertures having spatial resolution of $\lambda/20$ is also shown. The effect of screen thickness and composition can be included in detailed designs, but do not alter the basic advantages of improved transmission and spatial resolution provided by the invention.

9 Claims, 4 Drawing Sheets

NEAR-FIELD APERTURE HAVING A FRACTAL ITERATE SHAPE

CROSS REFERENCE TO RELATED APPLICATIONS

This application is a US national stage entry of international application PCT/US2005/038042, filed on Oct. 21, 2005. Application PCT/US2005/038042 claims the benefit of U.S. provisional application 60/621,714, filed on Oct. 22, 2004, entitled "Fractal Extensions of Near-Field Nano Aperture Shapes for Enhanced Transmission and Improved Resolution".

GOVERNMENT SPONSORSHIP

This invention was made with Government support under grant number CCR-0082898-002 from the National Science Foundation. The Government has certain rights in this invention.

FIELD OF THE INVENTION

This invention relates to near-field transmission of electromagnetic waves.

BACKGROUND

Optical characterization entails illuminating a sample with electromagnetic radiation and receiving radiation emitted from the sample responsive to its illumination. It is often desirable to increase the signal received from the sample given a fixed level of illumination (i.e., increase efficiency) and/or to increase the spatial resolution of the measurement, and various methods have been developed to accomplish these purposes. In particular, it is often desired to provide high spatial resolution and high efficiency simultaneously. Due to the diffraction limit, special methods are required to provide high efficiency at sub-wavelength spatial resolution. For example, sub-wavelength resolution can be provided by placing a sub-wavelength aperture between the radiation source and the sample, and placing the sample in the near field of the resulting aperture radiation pattern. However, radiation transmission efficiency through a sub-wavelength aperture tends to be very low, so the resulting scheme provides enhanced spatial resolution but significantly reduces efficiency.

Various approaches have been considered for addressing this problem. US 2005/0084912 considers a nanolens including plasmon resonance particles used to emit radiation for near-field sample characterization. Resonant enhancement is exploited to increase efficiency. U.S. Pat. No. 6,781,690 considers microcavities in combination with fractal nanoparticles, where efficiency is increased by cavity resonance and resonance within aggregates of fractal nano-particles. In US 2005/0218744, a medium having randomly distributed metallic particles near the percolation threshold is considered for optical characterization. In US 2005/0031278, a C-shaped sub-wavelength aperture is considered for increasing efficiency while maintaining high spatial resolution.

Although the approaches considered above should provide improved performance compared to a simple circular (or square) sub-wavelength aperture, there is room for further improvement in efficiency and spatial resolution, since no optimal aperture shape appears to be known. Accordingly, it would be an advance in the art to provide such improved combinations of efficiency and spatial resolution.

SUMMARY

The present invention provides near-field electromagnetic devices having an opaque metallic screen with a fractal iterate aperture. More specifically, the fractal iterate aperture is obtained by application of a self-similar replacement rule to an initial shape two or more times. Alternatively, the aperture can be obtained by application of a self-similar replacement rule one or more times to an initial C-shape. Such apertures tend to have multiple transmission resonances due to their multiple length scales. Fractal iterate apertures can provide enhanced transmission and improved spatial resolution simultaneously. Enormous improvement in transmission efficiency is possible. In one example, a checkerboard fractal iterate aperture provides $10^{11}$ more intensity gain than a square aperture having the same spatial resolution. Efficient transmission for fractal iterate apertures having spatial resolution of $\lambda/20$ is also shown. The effect of screen thickness and composition can be included in detailed designs, but do not alter the basic advantages of improved transmission and spatial resolution provided by the invention. Applications of the invention include near-field electromagnetic devices for nano-lithography, data storage and/or single-molecule studies.

DETAILED DESCRIPTION

The present invention provides an improved combination of efficiency and spatial resolution for a near-field electromagnetic device including an aperture in an opaque metal plate. More specifically, the aperture has a shape which is substantially determined by applying a self-similar replacement rule to an initial shape two or more times. Alternative aperture shapes of the invention can be obtained by applying a self-similar replacement rule one or more times to an initial C-shape. Such shapes are often known as fractal shapes, especially in the limit where the replacement rule is applied an infinite number of times. Accordingly, the invention relates generally to aperture shapes which are finite-iteration fractal iterates.

Figure 1:
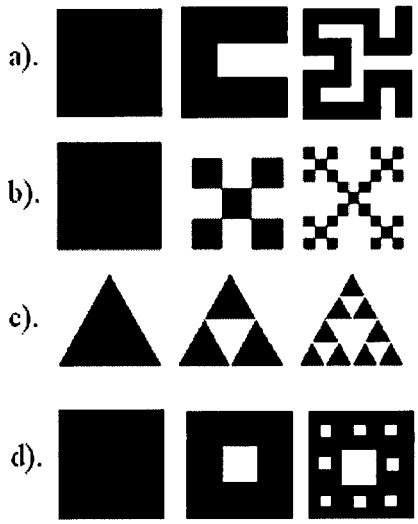
FIG. 1 shows various aperture shapes, some of which relate to embodiments of the invention.

FIG. 1 shows some examples of fractal iterate shapes of the invention, compared to other aperture shapes. More specifically, part (a) of FIG. 1 shows a square aperture, a C-shape aperture, and a Hilbert curve aperture. Part (b) of FIG. 1 shows a square aperture and the first two iterates of a checkerboard fractal (sometimes known as the Purina® fractal). Part (c) of FIG. 1 shows a triangular aperture and the first two iterations of the Sierpinski triangle fractal. Part (d) of FIG. 1 shows a square aperture and the first two iterates of the Sierpinski carpet fractal.

For the purposes of this description, a self similar replacement rule is defined as follows. Let an input shape $S^i$ have one or more parts $P_k$. A self-similar replacement rule entails replacing each $P_k$ with a corresponding $P_k'$, each $P_k'$ including two or more smaller scale replicas of $P_k$. Completion of this substitution provides the output shape $S^{i+1}$. Here the superscript i is for the fractal iteration, and the subscript k is for parts of the shape being replaced.

For the examples of FIG. 1*b-d*, the self-similar replacement rule being followed in each case is readily apparent. In particular, the rule for FIG. 1*b* (checkerboard fractal) is replacement of a square with a 3×3 checkerboard including smaller squares. The rule for FIG. 1*c* (Sierpinski triangle) is replacement of a triangle with a set of three smaller triangles surrounding a central triangular void. The rule for FIG. 1*d* (Sierpinski carpet) is replacement of a square with a set of eight smaller squares surrounding a central square void.

The replacement rule for the example of FIG. 1*a* (Hilbert curve) is somewhat more complex. One factor to consider is that the Hilbert curve is mathematically defined as a 1-dimensional fractal as opposed to the two dimensional fractals of FIG. 1*b-d*. In fact, the Hilbert curve is an example of a space-filling curve. A mathematical Hilbert curve iterate consists of a number of line segments. Physical apertures based on a Hilbert curve iterate are obtained by assigning a finite width to the line segments of a Hilbert curve iterate (as shown on FIG. 1*a*). Such apertures have shapes which are substantially determined by a fractal iteration, since broadening mathematical line segments to have a finite width does not change the basic features of the shape.

Figure 2A:
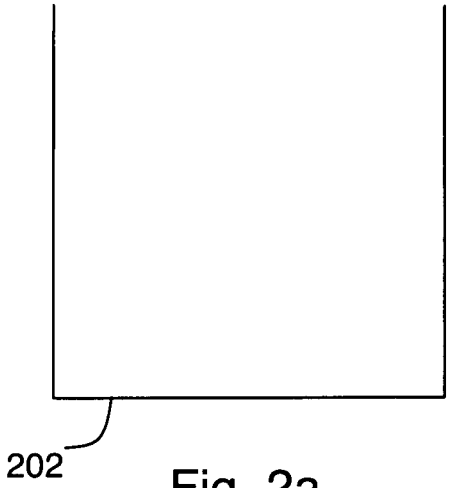
FIGS. 2*a-c* show the first few iterates of the Hilbert curve fractal.
Figure 2B:
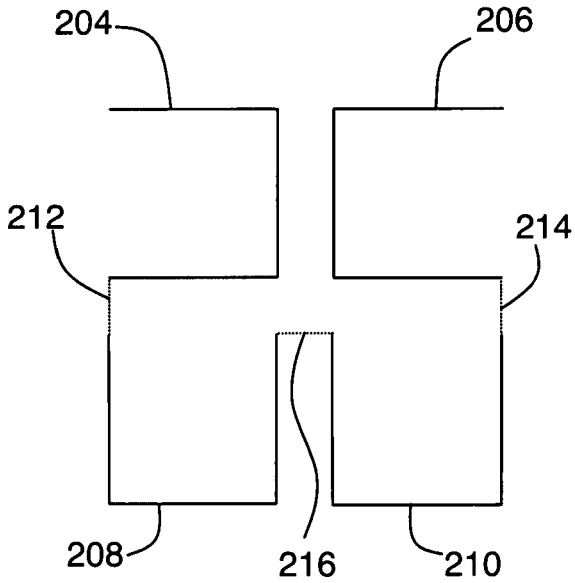
Figure 2C:
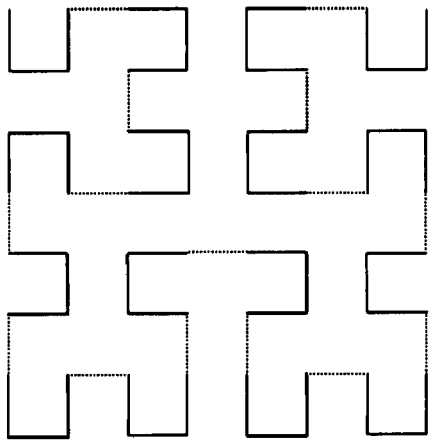

FIGS. 2*a-c* show a suitable replacement rule for generating Hilbert curve iterates. FIG. 2*a* shows an initial shape 202, which is C-shaped. It is convenient to refer to such C-shapes as "cups" in the following description. FIG. 2*b* shows the result of applying the Hilbert curve replacement rule to the shape of FIG. 2*a*. More specifically, the cup of FIG. 2*a* is replaced by an arrangement having 4 smaller cups (204, 206, 208, and 210) connected by three line segments (212, 214, and 216), collectively referred to as "joins". The replacement rule for the Hilbert curve is thus the replacement of each cup (as in FIG. 2*a*) with the arrangement of smaller cups and joins of FIG. 2*b*. The result of applying this rule to the shape of FIG. 2*b* is shown on FIG. 2*c*. In this example, the cups are the parts $P_k$ of the general replacement rule given above.

It should be noted that fractals and fractal iterate shapes are described in various ways in the art. Such details of nomenclature and terminology for describing fractal iterates are not critical in practicing the invention. For example, the Hilbert curve iteration rule (for the finite width case) can be also be described in terms of replacing sections of the curve with an arrangement of similar and smaller sections, some of which are rotated. Whether this replacement rule is used or the replacement rule of FIGS. 2*a-c* is used, the rightmost aperture shape on FIG. 1*a* can result, which is an embodiment of the invention. Similarly, minor departures from exact mathematically defined fractal iterate shapes (e.g., caused by fabrication tolerances or other physical imperfections) do not affect the basic principles of the invention. Such effects can be accounted for in detailed designs. The invention relates to any aperture shape which is substantially a fractal iterate (i.e., readily recognizable as a fractal iterate).

In order to compare the performance of various embodiments of the invention with each other and with conventional square apertures, it is convenient to adopt the following notation. On FIG. 1*a*, the shapes in the first, second and third columns are referred to as first, second and third iteration shapes respectively. Although the C-shape of FIG. 1*a* cannot be obtained from a square by the replacement rule of FIGS. 2*a-c*, this "iteration" terminology is still convenient for comparison purposes, since the first iteration shapes for the Hilbert curve, Sierpinski carpet and checkerboard fractals are all squares.

Figure 3A:
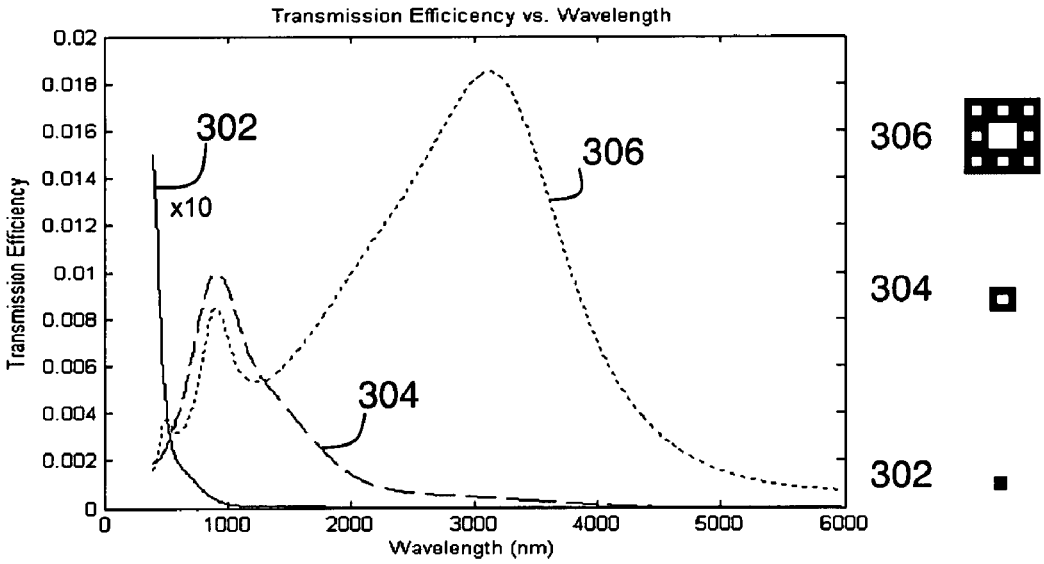
FIGS. 3*a-b* show transmission efficiency vs. wavelength for Sierpinski carpet and checkerboard fractal iterates respectively.
Figure 3B:
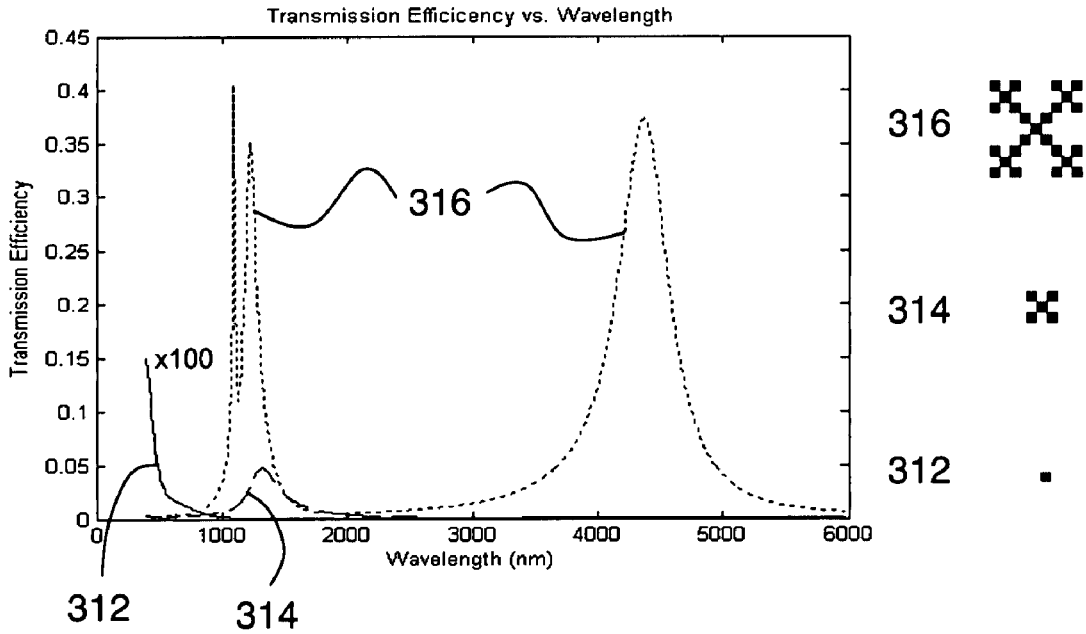

FIGS. 3*a-b* show calculated transmission efficiency vs. wavelength for Sierpinski carpet iterates and checkerboard fractal iterates. Curves 302, 304, and 306 on FIG. 3*a* relate to Sierpinski carpet iterates 1, 2, and 3 respectively. Curves 312, 314, and 316 on FIG. 3*b* relate to checkerboard fractal iterates 1, 2, and 3 respectively. The computations of FIGS. 3*a-b* are finite-difference time-domain computations assuming a broadband Gaussian pulse incident on an aperture of the indicated shape having a minimum feature size of 140 nm. The apertures are placed in a infinitesimally thin perfectly electrically conductive (PEC) screen in order to avoid complications from thickness and/or material resonances. For computational efficiency, the transmission efficiency is calculated by sampling the intensity at several points within the aperture radiation pattern, and normalizing to the incident spectral power distribution and the area of the aperture. Here the notation (n,m) is used where n is the fractal iteration (as on FIG. 1), and m is the resonance order. Fractal iterate aperture shapes generally have multiple resonant wavelengths at which transmission efficiency is maximized.

As the fractal iteration number increases, two effects occur. First, a new long-wavelength resonance appears. Second, resonances present in an earlier iterate can become stronger and/or spectrally more narrow. This allows fractal iterate apertures to be useful in two regimes. In cases where existing resonances are enhanced, the fractal iterate aperture can increase transmission by collecting radiation from a larger area. This mode is especially relevant in cases where the aperture is illuminated with radiation that is not diffraction limited. In cases where the new long-wavelength resonance is employed, the aperture can be rescaled to align the longest wavelength resonance with a desired operating wavelength. In favorable cases, such rescaling can provide enhanced spatial resolution. Note that scaling of aperture and wavelength in the computation of FIGS. 3*a-b* is a roughly linear scaling, where increasing the maximum feature size by a factor Z increases the longest resonant wavelengths by the same factor Z.

For more detailed comparisons of aperture performance, each resonance of each fractal iterate was individually considered. For each of these cases, the screen thickness was taken to be 100 nm and the aperture was scaled to set the relevant resonance wavelength to 1 μm. The shift in resonance wavelength due to a finite screen thickness was accounted for in this scaling. Detailed near field distributions were calculated at a distance d/2 from the aperture, where d is the minimum feature size of the scaled aperture. This distance was chosen because the fields rapidly diverge for distances larger than d/2 (i.e., d/2 marks the boundary of the confined near-zone described by Leviatan, within which the fields are largely collimated).

For simple apertures, the spatial resolution can be assumed to scale with the aperture size in a simple way. For fractal iterate apertures, such simple scaling does not always hold. In particular, it is important to distinguish cases where the near field radiation pattern has a single well-localized spot from cases where the near-field radiation pattern has two or more spots, or is otherwise spread out. Whether or not the near-field radiation pattern has a single spot depends on both the fractal type and on the particular resonance being considered.

Figure 5:
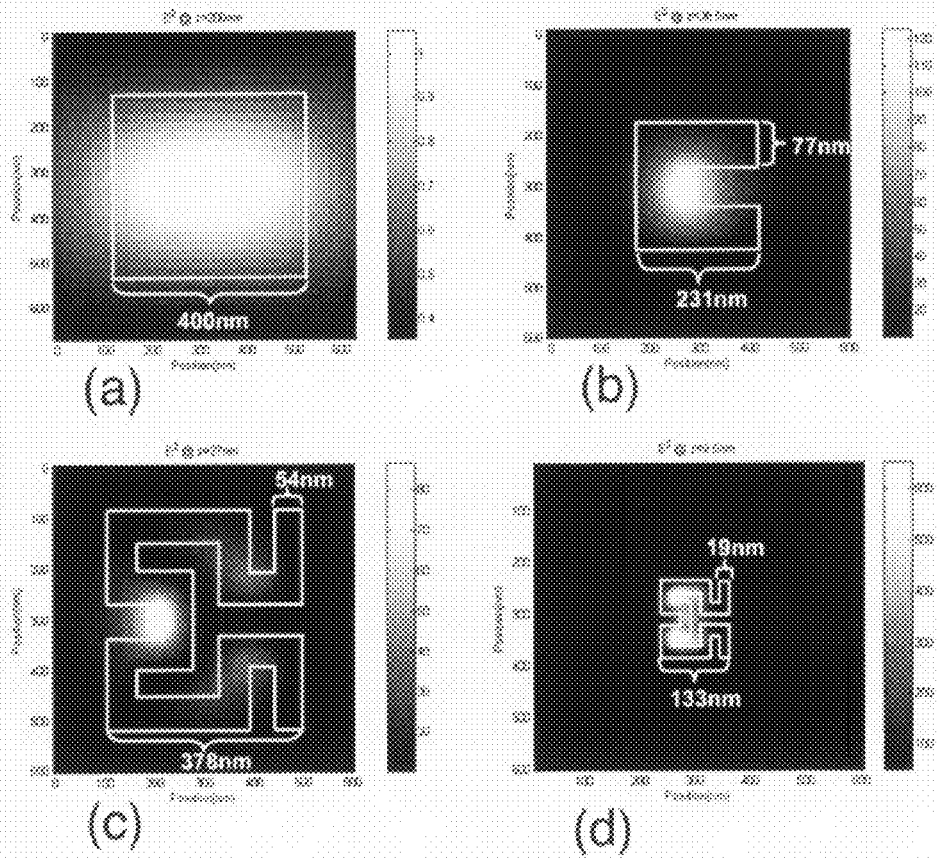
FIG. 5 shows calculated near field intensity distributions for some apertures based on the Hilbert curve fractal.

FIG. 5 shows some exemplary calculated near-field intensity distributions. The aperture for each case is shown with white lines. Parts (a), (b), (c), and (d) of FIG. 5 show intensity distributions for the Hilbert (1,1), (2,2), (3,2) and (3,3) cases respectively. The Hilbert (3,3) case has a two spot pattern and the Hilbert (3,2) case has a single spot pattern. The calculations for parts (a), (b), (c) and (d) of FIG. 5 are performed at distances of 200 nm, 38.5 nm, 27 nm, and 9.5 nm respectively. These distances are one half of the respective minimum feature sizes of 400 nm, 77 nm, 54 nm, and 19 nm.

Quantitative performance comparisons are facilitated by defining the following figures of merit, calculated from the above near-field distributions at distance d/2. The intensity gain $I_g$ is given by $$I_g = \frac{\int_{FWHM}\int E^2\, dA}{E_i^2 A_{FWHM}},$$

where the integral is performed within the high intensity (i.e., greater than half-maximum) part of the field pattern, $E_i$ is the incident electric field amplitude, E is the transmitted electric field amplitude, and $A_{FWHM}$ is the area of the high intensity part of the field pattern. Thus $I_g$ is essentially the average intensity enhancement within the near field spot(s). The intensity gain is a more appropriate figure of merit for efficiency than power transmission for embodiments of the invention, because it accounts properly for near field patterns having various shapes. The figure of merit for resolution is the confinement factor CF, which is given by $$CF = \frac{2\lambda}{X_{FWHM} + Y_{FWHM}}.$$

Here $\lambda$ is the wavelength of the incident radiation, and $X_{FWHM}$ and $Y_{FWHM}$ are the full width half-maximum near field spot sizes in two orthogonal directions (e.g., x and y).

Figure 4:
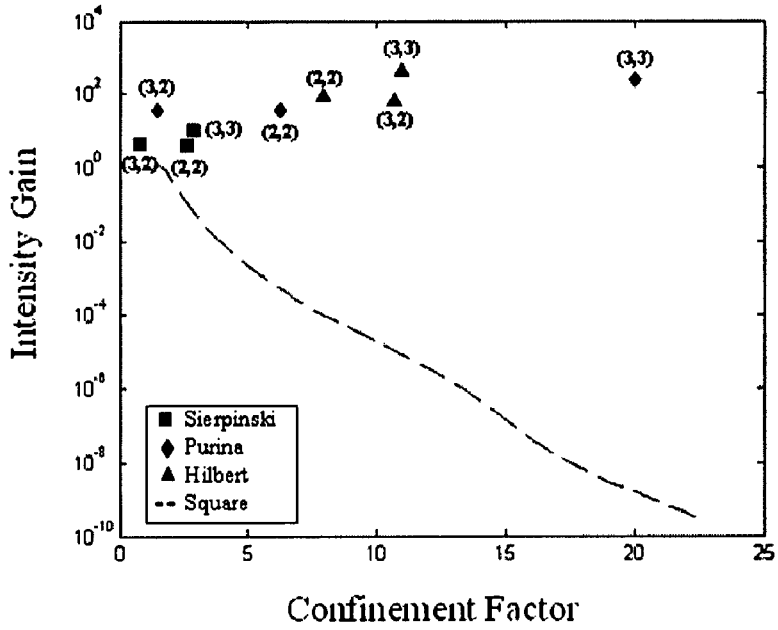
FIG. 4 shows a performance comparison of embodiments of the invention to each other and to conventional square and C-shaped apertures.

FIG. 4 shows calculated results for intensity gain ($I_g$) and confinement factor (CF). The first noteworthy feature on FIG. 4 is the dashed line showing the performance of a square aperture. Here the above-mentioned trade off between resolution and efficiency is readily apparent. For example, a square aperture having a confinement factor of about 20 has an intensity gain of less than $10^{-8}$. The squares, diamonds and triangles show the performance of Sierpinski carpet, checkerboard fractal, and Hilbert curve aperture shapes respectively.

From FIG. 4, it is apparent that Hilbert curve iterates provide the highest intensity gain ($I_g$=441 for the (3,3) case) of the shapes studied, while the checkerboard fractal (3,3) provides the best confinement factor (about 20) of the shapes studied. Note that the checkerboard (3,3) aperture provides an intensity gain that is greater by a factor of $10^{11}$ than a square aperture providing the same spot size. The Sierpinski carpet iterates are not particularly useful in the near field, in contrast to their utility in far-field applications (e.g., microwave antennas). In many cases, the results shown on FIG. 4 are qualitatively explicable in terms of the near field radiation patterns. For example, the Hilbert (3,3) aperture does not provide significantly better CF than the Hilbert (3,2) aperture because the corresponding near field patterns have two spots and one spot respectively. In contrast, the checkerboard (3,3) aperture has a single-spot near field pattern, which provides a high CF.

As indicated by these examples, the performance of a fractal iterate aperture depends on the kind of fractal the aperture shape is derived from. The examples given above are well-known classical fractals, but they are by no means an exhaustive description of fractals. The invention can be practiced with aperture shapes derived from any fractal. A useful parameter for describing fractals is the fractal dimension D=log(N)/log(S), where N is the number of self-similar copies from one iteration to the next, and 1/S is the size reduction factor of these copies. Fractal iterates from fractals having a relatively high fractal dimension (i.e., D>about 1.7), such as Hilbert curve iterates (D=1.9), tend to provide high intensity gain and enhanced transmission because they fill a large fraction of available space and their scaling factor S is relatively small. Fractal iterates from fractals having a relatively low fractal dimension (i.e., D<about 1.7), such as checkerboard fractal iterates (D=1.46), tend to be sparse, branching structures that can efficiently suppress side lobes and provide a highly localized near field spot. Low D fractal iterates also tend to have a relatively large scaling factor S, and the resulting rapid decrease in minimum feature size with each iteration of the fractal rule provides further enhanced resolution. Thus high D fractal iterates tend to provide high intensity gain, while low D fractal iterates tend to provide high confinement factor, as seen in the examples of FIG. 4.

Another property of fractals that is useful to consider when selecting an aperture shape is lacunarity, which is a measure of how much "open space" a fractal has. Lacunarity is preferably low, in order to improve localization of the near field beam pattern (ideally to a single small spot). The Sierpinski carpet is an example of a high lacunarity fractal, while the Hilbert and checkerboard fractals have low lacunarity.

Figure 6:
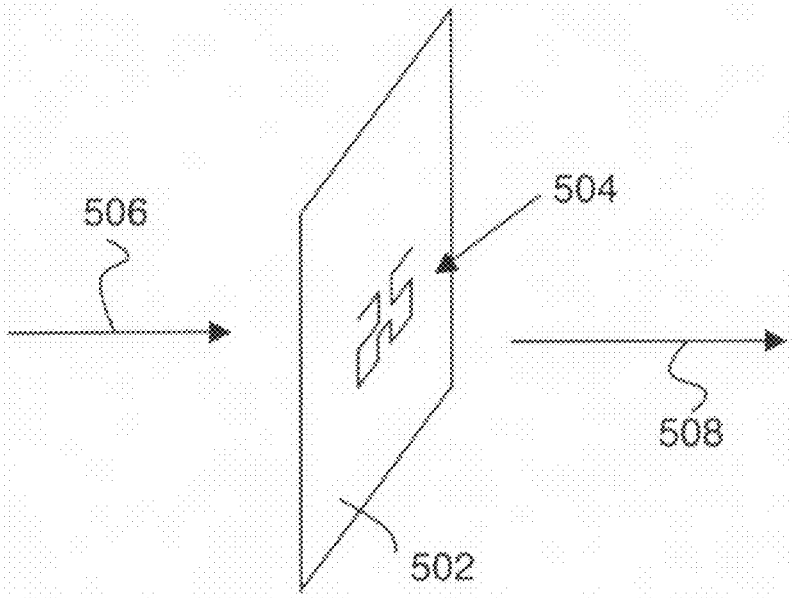
FIG. 6 shows an embodiment of the invention.

FIG. 6 shows an embodiment of the invention. An opaque metal screen 502 has a fractal iterate aperture 504 in it. Metal screen 502 can be Au, Ag or any other material that is opaque and metallic at the wavelengths or frequencies of interest. Aperture 504 is a fractal iterate aperture as described above.

In order to focus on the effect of aperture shape alone, complications due to finite screen thickness and the optical response of screen materials have been largely neglected thus far. Such effects can be included in detailed design in order to optimize an aperture for a particular application. For example, a Drude model can be used to provide an optical response model for a metallic screen material. A design of a Hilbert (3,2) aperture operating at a 1 μm wavelength in a 100 nm thick Ag screen was performed. The Drude model parameters were $\epsilon_{inf}$=3.81, $\tau_c$=8.96×$10^{-15}$ s and $\omega_p$=6.79×$10^{15}$ r/s. In the Drude model calculation, the intensity gain was lower than for the PEC case (31.3 vs. 61.6) because of losses within the metal due to its finite conductivity, but the resolution was improved (56.4 nm×63.7 nm vs. 83.8 nm×101.4 nm). The reason for this improvement in resolution is that the optical response of the Ag screen red shifts the resonance wavelength compared to the PEC case, so the Ag aperture has to be made smaller than the PEC aperture in order to set the resonance wavelength to 1 μm. The Ag aperture calculations were also performed closer to the aperture than the PEC aperture calculation, since d/2 is smaller for the Ag case.

There are additional design optimizations that can be considered in practicing the invention. For example, parameters of the aperture shape (e.g., line width of the Hilbert curve iterates) can be adjusted to maximize $\lambda_{res}$ (for a fixed resonance order) or to maximize $\lambda_{res}$/A, where A is the aperture area. Longitudinal resonances can also be considered. It is preferable for the thickness of the aperture screen to be selected to provide longitudinal resonance. Such resonances typically occur when the screen thickness is at or near a multiple of $\lambda/2$, where $\lambda$ is the operating wavelength, and decrease in strength as the screen thickness increases (due to loss in the screen material). Although the preceding description has concentrated on optical examples, the invention is applicable to near-field electromagnetic devices at any frequency.

The invention claimed is:

1. A near-field electromagnetic device comprising:

a opaque metal plate; and an aperture in the plate and having an area A;

wherein the aperture has an aperture shape substantially determined by applying a self-similar replacement rule two or more times to an initial shape, whereby the aperture shape is an iterate of a fractal.

2. The device of claim 1, wherein a thickness of said metal plate is selected to provide a longitudinal transmission resonance at an operating wavelength.

3. The device of claim 1, wherein said aperture has a transmission resonance wavelength $\lambda_{res}$ and wherein parameters of said aperture shape are selected to maximize $\lambda_{res}/\sqrt{\sqrt{A}}$.

4. The device of claim 1, wherein said fractal is selected from the group consisting of: the Hilbert curve, the checkerboard fractal, the Sierpinski triangle and the Sierpinski carpet.

5. The device of claim 1, wherein a fractal dimension of said fractal is above about 1.7, whereby intensity gain of said aperture is enhanced.

6. The device of claim 1, wherein a fractal dimension of said fractal is below about 1.7, whereby resolution of said aperture is enhanced.

7. A near-field electromagnetic device comprising:

a opaque metal plate; and an aperture in the plate and having an area A;

wherein the aperture has an aperture shape substantially determined by applying a self-similar replacement rule one or more times to an initial C-shape, whereby the aperture shape is an iterate of a Hilbert curve.

8. The device of claim 7, wherein a thickness of said metal plate is selected to provide a longitudinal transmission resonance at an operating wavelength.

9. The device of claim 7, wherein said aperture has a transmission resonance wavelength $\lambda_{res}$ and wherein parameters of said aperture shape are selected to maximize $\lambda_{res}/\sqrt{\sqrt{A}}$.

* * * * *